US010337183B2

(12) United States Patent
Matsuo et al.

(10) Patent No.: US 10,337,183 B2
(45) Date of Patent: Jul. 2, 2019

(54) FLUSH TOILET

(71) Applicant: TOTO LTD., Kitakyushu-shi, Fukuoka (JP)

(72) Inventors: Naoto Matsuo, Kitakyushu (JP); Eiji Shiohara, Kitakyushu (JP); Hiroyuki Hara, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/416,279

(22) Filed: Jan. 26, 2017

(65) Prior Publication Data

US 2017/0241119 A1 Aug. 24, 2017

(30) Foreign Application Priority Data

Feb. 18, 2016 (JP) ..... 2016-028550

(51) Int. Cl.
*E03D 1/00* (2006.01)
*E03D 11/08* (2006.01)

(52) U.S. Cl.
CPC ..... *E03D 11/08* (2013.01); *E03D 1/00* (2013.01)

(58) Field of Classification Search
CPC ..... E03D 11/08; E03D 1/00
USPC ..... 4/420
See application file for complete search history.

(56) References Cited

U.S. PATENT DOCUMENTS 6,000,070 A * 12/1999 Bonin ..... E03D 11/08 4/420
6,145,138 A * 11/2000 Nakamura ..... E03D 11/08 4/420
9,157,225 B2 * 10/2015 Kashirajima ..... E03D 11/08 4/420
2014/0289947 A1 * 10/2014 Hirakawa ..... E03D 11/08 4/421
2014/0289948 A1 * 10/2014 Kitaura ..... E03D 11/08 4/432
2015/0267389 A1 9/2015 Luettgen et al.

FOREIGN PATENT DOCUMENTS

CN 105189881 A 12/2015
JP 4062731 B2 * 3/2008 ..... E03D 11/08
JP 2015-158128 A 9/2015

OTHER PUBLICATIONS

An Office Action issued by the Chinese Patent Office dated Dec. 5, 2018, which corresponds to Chinese Patent Application No. 201710075493.9 and is related to U.S. Appl. No. 15/416,279; with partial English language translation.

* cited by examiner

*Primary Examiner* — Tuan N Nguyen
(74) *Attorney, Agent, or Firm* — Studebaker & Brackett PC

(57) ABSTRACT

There is provided a flush toilet that cleans a bowl using a swirl flow formed by cleaning water flowing down from a slit aperture formed on a rim. The flush toilet has a discharge passage an inlet of which is connected to a lower portion of a waste receiving having a bowl shape, and an inlet of an inlet conduit of the discharge passage is formed such that on a horizontal cross-section plane a maximum width of a front portion in a left-right direction is larger than a maximum width of a rear portion in the left-right direction.

6 Claims, 4 Drawing Sheets

FLUSH TOILET

BACKGROUND OF THE INVENTION

Field of the Invention

The present invention relates to a flush toilet, and particularly, to a flush toilet that cleans a bowl using a swirl flow formed by cleaning water flowing down from a rim.

Description of the Related Art

There is conventionally known a flush toilet provided with a so-called open rim structure in which a slit aperture is formed on a bottom surface of a rim water passage in a bowl. Since such a flush toilet cleans the bowl by causing cleaning water to flow down substantially right below from the slit aperture on the bottom surface of the rim water passage, there occurs a problem of a cleaning defect because of a relatively weak cleaning force to the bowl.

On the other hand, as shown in Japanese Patent Unexamined Publication No. 2015-158128 (JP2015-158128A), there is known a flush toilet in which an ascending conduit of discharge trap is formed in a mountain shape in section, a velocity of a water flow on the bottom side of the ascending conduit is increased and a velocity of a water flow on the upper side is decreased. Thereby an entire velocity of the water flows in the ascending conduit is appropriately maintained to cause the cleaning water to smoothly flow without a pressure loss, thus enhancing a cleaning efficiency.

SUMMARY OF THE INVENTION

However, in the flush toilet with the rim having the conventional open rim structure, when a cleaning water amount for the cleaning is reduced because of a recent demand for economization of water, the momentum of the cleaning water to be supplied to the rim water passage is made weak because of a reduction in cleaning water amount, causing flow of the cleaning water flowing in the bowl and in the discharge trap to be weak. Therefore there occurs a problem of a defect in the cleaning of the bowl and the discharge trap.

Therefore, the inventors of the present invention have studied formation of a swirl flow swirling on an upper portion of the bowl by the cleaning water flowing down from the rim in the open rim structure for improving cleaning performance in the flush toilet. However, even in a combination with the structure of the ascending conduit as described in Japanese Patent Application Laid-Open No. 2015-158128, since it is impossible to maintain the swirl flow generated on the upper portion of the bowl in the discharge trap, the cleaning force of the cleaning water is still relatively weak in the discharge trap, creating a problem that the cleaning performance is not secured.

Therefore the present invention is made for solving the foregoing problems in the conventional technology, and an object of the present invention is to provide a flush toilet that can keep on a swirl flow in a discharge passage, enhance discharging performance of wastes, and secure excellent cleaning performance.

For achieving the above object, the present invention provides a flush toilet that cleans a bowl using a swirl flow formed by cleaning water flowing down from a rim, comprising: a toilet main body; and a water supply device that supplies the cleaning water to a supply opening of the toilet main body; the toilet main body including: a bowl having a waste receiving surface having a bowl shape, a rim provided on an upper portion of the waste receiving surface, a rim water passage formed on an entire circumference of the rim to introduce the cleaning water, and a slit aperture formed on a lower portion of the rim water passage, the cleaning water flowing down from the slit aperture; a water conduit formed between the supply opening and the rim water passage; and a discharge passage including an inlet conduit provided with an inlet connected to a lower portion of the waste receiving surface of the bowl, an ascending conduit extending upward from a lower end of the inlet conduit, and a descending conduit extending downward from the ascending conduit, wherein the inlet of the discharge passage is formed such that on a horizontal cross-section plane a maximum width of a front portion in a left-right direction is larger than a maximum width of a rear portion in the left-right direction.

According to the present invention as thus configured, in the flush toilet that cleans the bowl using the swirl flow formed by the cleaning water flowing down from the rim having the so-called open rim structure, since the inlet of the discharge passage is formed such that on the horizontal cross-section plane the width of the front portion in the left-right direction is larger than the width of the rear portion in the left-right direction, the swirl flow flowing down on the waste receiving surface having the bowl shape tends to easily flow into the discharge passage while keeping on the swirl from the inlet of the discharge passage. Therefore it is possible to suppress the swirl flow from being disturbed when the swirl flow flows into the inlet of the discharge passage, keep on the swirl flow in the discharge passage, and enhance the discharging performance of the wastes, securing the excellent cleaning performance of the flush toilet.

According to the present invention, preferably the inlet conduit of the discharge passage is formed such that on a cross-section plane perpendicular to the discharge passage a maximum width of a bottom surface portion in the left-right direction is larger than a maximum width of a ceiling surface portion in the left-right direction.

According to the present invention as thus configured, in the inlet conduit of the discharge passage, the width of the bottom surface portion in the left-right direction in which the cleaning water and the wastes tend to easily move under an influence of gravity is larger than the width of the ceiling surface portion in the left-right direction. Therefore it is possible to more certainly keep on the swirl flow in the inlet conduit, and further enhance the discharging performance of the wastes, securing the excellent cleaning performance of the flush toilet.

According to the present invention, preferably at least a part of the ascending conduit of the discharge passage is formed such that on a cross-section plane perpendicular to the discharge passage a maximum width of a bottom surface portion in the left-right direction is larger than a maximum width of a ceiling surface portion in the left-right direction.

According to the present invention as thus configured, in at least a part of the ascending conduit of the discharge passage, the width of the bottom surface portion in the left-right direction in which the cleaning water and the wastes tend to easily move under an influence of gravity is larger than the width of the ceiling surface portion in the left-right direction. Therefore it is possible to more certainly keep on the swirl flow in the ascending conduit, and further enhance the discharging performance of the waste, securing the excellent cleaning performance of the flush toilet.

According to the present invention, preferably the ascending conduit of the discharge passage includes an inlet connected to the inlet conduit, an exit connected to the descending conduit, and an intermediate portion formed between the inlet and the exit, wherein a height from the bottom surface to the ceiling surface on a cross-section plane perpendicular to the discharge passage is constant at least between the intermediate portion and the exit in the ascending conduit.

According to the present invention as thus configured, in the ascending conduit of the discharge passage, the height of the swirl flow formed between the bottom surface and the ceiling surface can be maintained to be substantially constant at least between the intermediate portion and the exit in the ascending conduit. Therefore it is possible to more certainly keep on the swirl flow, and further enhance the discharging performance of the wastes, securing the excellent cleaning performance of the flush toilet.

According to the present invention, preferably the ascending conduit of the discharge passage is formed such that a cross-section area in a cross-section plane perpendicular to the discharge passage lying downstream of the inlet connected to the inlet conduit is smaller than a cross-section area in a cross-section plane perpendicular to the discharge passage of the inlet.

According to the present invention as thus configured, in the ascending conduit of the discharge passage, the cross-section area in the cross-section plane perpendicular to the discharge passage lying downstream of the inlet connected to the inlet conduit is smaller than the cross-section area in the cross-section plane perpendicular to the discharge passage of the inlet. Therefore since the cleaning water is collected in a narrower flow passage in a portion lying downstream of the inlet in the ascending conduit, a push-out force of the cleaning water to the wastes can be hard to be reduced.

According to the present invention, preferably the flush toilet is a washing-away type flush toilet that discharges wastes using a drop of the cleaning water supplied to the toilet main body from the water supply device in a height direction of the bowl.

According to the flush toilet of the present invention, it is possible to keep on the swirl flow in the discharge passage, and enhance the discharging performance of the wastes, securing the excellent cleaning performance.

DETAILED DESCRIPTION OF THE PREFERRED EMBODIMENT

Hereinafter, an explanation will be made of a flush toilet according to an embodiment of the present invention with reference to the accompanying drawings.

Hereinafter, in the explanation of the embodiment in the present invention, when a toilet main body 2 is viewed from a user using the toilet main body 2, the near side is defined as a front side, the depth side as viewed from a user is defined as a rear side. When the toilet main body 2 is viewed from the front side, the right side is defined as a right side and the left side as viewed from the front side is defined as a left side.

Figure 1:
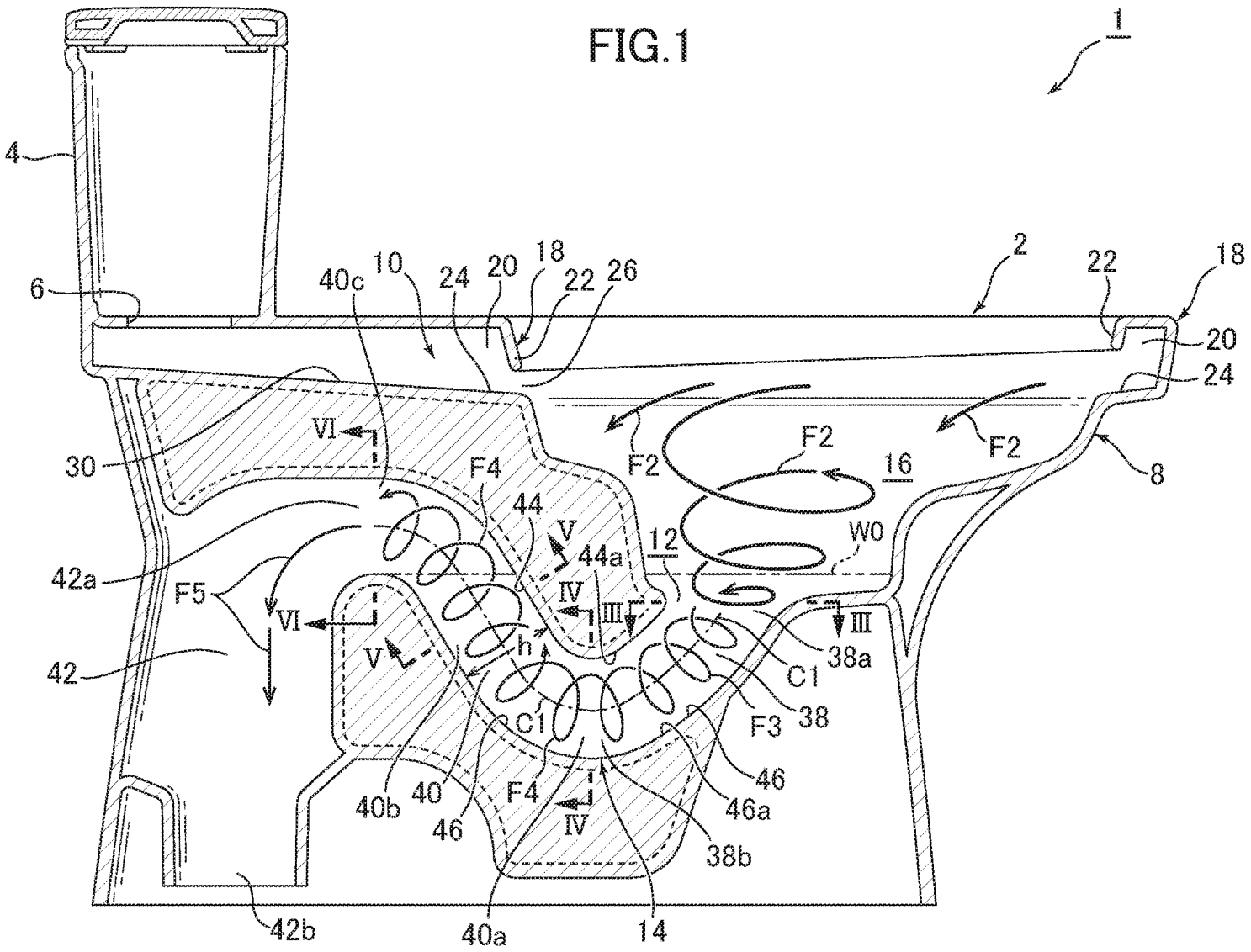
FIG. 1 is a side cross-sectional view illustrating a flush toilet according to an embodiment of the present invention.
Figure 2:
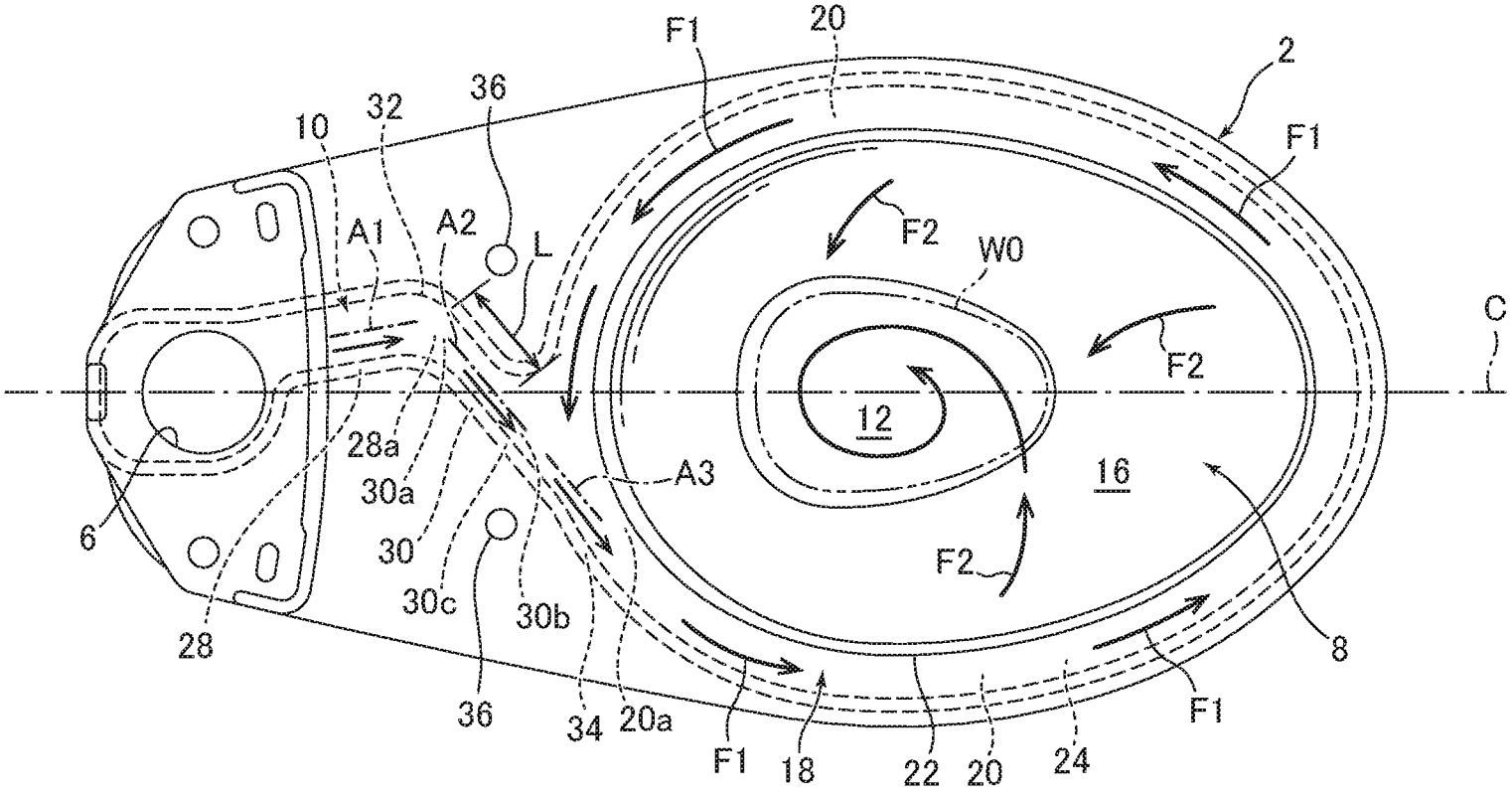
FIG. 2 is a plan view of a toilet main body in the flush toilet according to the embodiment of the present invention.
Figure 3:
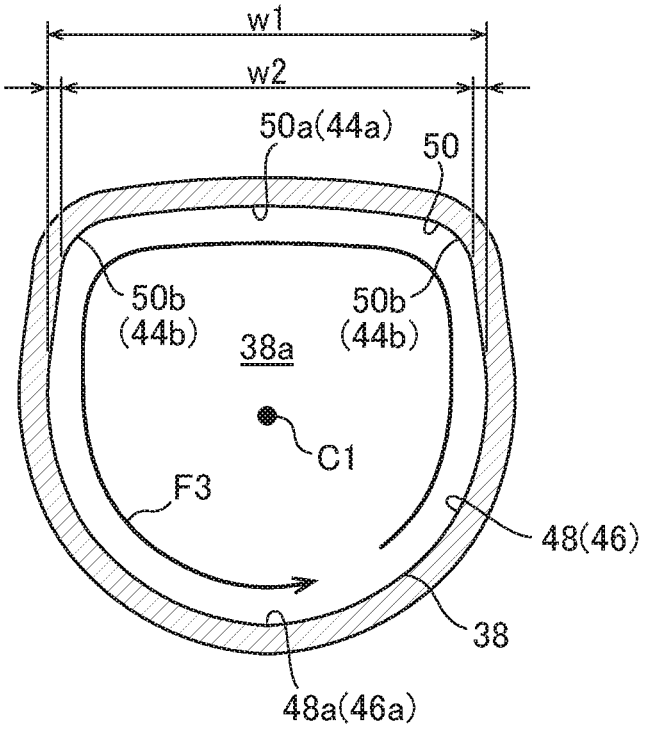
FIG. 3 is a cross-sectional view as shown along line III-III in FIG. 1.

As illustrated in FIG. 1 to FIG. 3, a flush toilet 1 according to a first embodiment of the present invention has the toilet main body 2 formed of a pottery vessel. A water storage tank 4 as a water supply device is mounted on an upper portion of the backside of the toilet main body 2.

Here, a cleaning water amount to be supplied from the water storage tank 4 is in a range of 3 L to 6 L, preferably in a range of 4.8 L to 6 L.

The water supply device is not only the water storage tank 4 but also may be a flush valve or the like that can supply a prescribed cleaning water amount.

A bowl 8 is formed on the front upper portion of the toilet main body 2, and a supply opening 6 to which the cleaning water is supplied from the water storage tank 4 is formed on the rear upper portion of the toilet main body 2, and further, a water conduit 10 introducing the cleaning water to the bowl 8 from the supply opening 6 is formed thereupon. The supply opening 6 is arranged substantially in the center of the toilet main body 2 as viewed from the front side of the toilet main body 2.

Further, a pooled water portion 12 is formed on a waste receiving surface 16 in the lower portion of the bowl 8, and pooled water having a pooled water surface in an initial water level indicated at W0 is stored in the pooled water portion 12. An inlet conduit 38 of a discharge passage 14 is connected to the lower portion of the pooled water portion 12 as described later.

The bowl 8 includes the waste receiving surface 16 formed in a bowl shape, and a rim 18 that is formed on an upper edge portion thereof to eject cleaning water on the waste receiving surface 16. The rim 18 is provided with a rim drooping wall 22 extending to droop to the vicinity of the waste receiving surface 16 downward from the upper surface, and a rim water passage 20 is formed in the inside (outside as viewed from the center of the toilet main body) of the rim 18 by the rim drooping wall 22.

The rim 18 is provided with a slit aperture 26 that is formed therein and by which the inside, lower portion of the rim water passage 20 formed along the peripheral direction of the rim 18 is opened over the entire circumference, configuring a so-called open rim. The slit aperture 26 forms a water ejection portion that ejects the cleaning water on the waste receiving surface 16.

The rim 18 is provided with a bottom surface of rim water passage 24 in a shelf shape formed over substantially the entire circumference of the bowl 8 between the waste receiving surface 16 and the rim 18. The bottom surface of rim water passage 24 forms a flat surface formed annularly on the upper portion of the bowl 8, and the flat surface is formed to be slightly inclined downward toward the inner direction from the outer direction of the bowl 8.

With the rim water passage 20, the cleaning water supplied from the water conduit 10 flows on the bottom surface of rim water passage 24 in the rim water passage 20 and can form the flow going around in a counterclockwise direction on the upper portion of the bowl 8.

Next, the details of the water conduit 10 will be described. As illustrated in FIG. 1 and FIG. 2, the supply opening 6 to which the aforementioned water storage tank 4 is connected is formed on the rear end of the water conduit 10 in the toilet main body 2, and the cleaning water supplied from the water storage tank 4 flows into the water conduit 10 of the toilet main body 2 from the supply opening 6 and flows out to the rim water passage 20 from the water conduit 10.

The water conduit 10 includes an upstream water conduit 28 extending to the right side (one side) of the toilet main body 2 in the left-right direction from the supply opening 6, and a downstream water conduit 30 extending to the left side (the other side) from the upstream water conduit 28 in the left-right direction. The water conduit 10 forms a flow passage bilaterally non-symmetric about a center axis line C of the toilet main body 2 in the left-right direction. The water conduit 10 forms a flow passage in a "<" shape by the upstream water conduit 28 and the downstream water conduit 30. The upstream water conduit 28 and the downstream water conduit 30 are connected by a bending portion 32, and the bending portion 32 is positioned in the right region about the center axis line C of the toilet main body 2.

The upstream water conduit 28 extends linearly toward the oblique right direction from the supply opening 6 positioned on the center axis line C in the left-right direction of the toilet main body 2, is arranged in a position non-symmetric about the center axis line C, and extends to an exit 28*a* arranged in the right vicinity of the center axis line C. The upstream water conduit 28 is formed to be gradually biased in the right region to the center axis line C from the upstream side to the downstream side.

A center axis line A1 of the upstream water conduit 28 has a front side inclined in the right outer direction to the center axis line C.

The downstream water conduit 30 extends to the left side from an inlet 30*a* connected to the exit 28*a* of the upstream water conduit 28 and forms a flow passage leading to an exit 30*b* connected to a left rear region 20*a* of the rim water passage 20. The downstream water conduit 30 forms a linear flow passage obliquely crossing the center axis line C of the toilet main body 2 from the inlet 30*a* to the exit 30*b*.

A center axis line A2 of the downstream water conduit 30 has a front side inclined in the left outer direction to the center axis line C. A crossing point between the center axis line A1 of the upstream water conduit 28 and the center axis line A2 of the downstream water conduit 30 is positioned in the right side to the center axis line C, and the exit 30*b* is positioned in the left side at the opposite side to the center axis line C.

The downstream water conduit 30 has the inlet 30*a* arranged in the right region to the center axis line C and the exit 30*b* arranged in the left region to the center axis line C. As a result, the downstream water conduit 30 forms a flow passage having a relatively long, predetermined length L. Since the inlet 30*a* of the downstream water conduit 30 is arranged in the right side to the center axis line C, a length from the inlet 30*a* to the exit 30*b* positioned in the left rear region of the bowl 8 is set to a relatively long length.

Since the downstream water conduit 30 has the flow passage having the relatively long length L, the cleaning water can be appropriately adjusted in flow in the downstream water conduit 30 to enhance the directivity of the cleaning water, and is ejected by the flow adjusted in the direction of going around on the rim water passage 20 from the exit 30*b* of the downstream water conduit 30 and by the flow in a relatively strong water momentum state. A length L of the flow passage of the downstream rim water conduit is set to a length of 25 mm to 115 mm.

The downstream water conduit 30 is formed such that a part thereof is in parallel to a part of a converging portion with the rim water passage 20. In the vicinity of the exit 30*b* of the downstream water conduit 30, a direction of the center axis line A2 of the downstream water conduit 30 substantially corresponds to a direction of a flow line A3 of the cleaning water going around on the rim water passage 20 in the left rear region of the bowl 8. Therefore the cleaning water flowing out from the exit 30*b* of the downstream water conduit 30 flows toward substantially the same swirling direction (going-around direction) on the rim water passage 20, making it possible to form the flow going around on the rim water passage 20 in a state of holding the water momentum (state of substantially maintaining the flow amount and flow velocity).

Accordingly it is possible to suppress the cleaning water converging with the rim water passage 20 from the downstream water conduit 30 from flowing on the rim water passage 20 toward the reverse swirling direction to the direction of a main flow on the rim water passage and from flowing down on the waste receiving surface 16 from the slit aperture 26.

In a region in which the downstream water conduit 30 and the rim water passage 20 are connected, an outer wall surface 30*c* of the downstream water conduit 30 and an outer wall surface of rim water passage 34 of the rim 18 are successively formed in a substantially flat shape. That is, the outer wall surface 30*c* and the outer wall surface of rim water passage 34 are formed to be flush in the connection portion vicinity, and an extension direction of the outer wall surface 30*c* corresponds to a tangential direction of the outer wall surface of rim water passage 34. Accordingly the cleaning water can smoothly flow along the flat surface linearly extending from the outer wall surface 30*c* of the downstream water conduit 30 to the outer wall surface of rim water passage 34 of the rim 18 to suppress a pressure loss of the flow flowing along the outer wall surface 30*c*.

The toilet main body 2 has attaching portions 36 for attaching a toilet seat on the toilet main body 2. The attaching portions 36 are provided in positions of the vicinity in both sides in the left and right of the toilet main body 2 in back of the rim water passage 20. Since the attaching portion 36 forms the attachment structure toward the inside of the toilet main body 2, the downstream water conduit 30 cannot be formed in a position of forming the attaching portion 36. The downstream water conduit 30 is formed between the attaching portions 36 in both sides in the left and right, therefore making it possible to provide the downstream water conduit 30 to avoid the attaching portions 36 and further, the flow passage in a relatively long length is formed.

Next, the discharge passage 14 will be in detail explained with reference to FIG. 1 to FIG. 6.

The discharge passage 14 includes the inlet conduit 38 connected to the lower portion of the waste receiving surface 16 of the bowl 8, the ascending conduit 40 obliquely extending toward the upper side from the lower end of the inlet conduit 38, and the descending conduit 42 extending downward in the perpendicular direction from the ascending conduit 40. An exit 42*b* of the descending conduit 42 is connected to a discharge conduit (unillustrated) mounted on the floor surface.

The inlet conduit 38 of the discharge passage 14 is connected in the inlet 38*a* to the lower portion of the waste receiving surface 16 of the bowl 8. The inlet 38*a* of the inlet conduit 38 is connected upward to the lower portion of the pooled water portion 12. The inlet conduit 38 forms an inlet of the discharge passage 14 on a horizontal cross-section plane in the lower portion of the waste receiving surface 16.

As illustrated in FIG. 1, the inlet conduit 38 of the discharge passage 14 extends from the front side to the rear side on the center axis line C of the toilet main body 2 in the front-rear direction, and is formed bilaterally symmetric about the center axis line C1 of the inlet conduit 38. The inlet conduit 38 extends obliquely downward from the inlet 38*a* toward the rear side and extends to the inlet 40*a* of the ascending conduit 40. In the inlet conduit 38 and the ascending conduit 40 of the discharge passage 14, an upper portion side forming a ceiling surface 44*a* is defined as a ceiling surface side, and a lower portion side forming a bottom surface 46*a* is defined as a bottom surface side. The inlet conduit 38 and the ascending conduit 40 of the discharge passage 14 can be sectioned into a ceiling surface portion 44 forming a curved surface of an approximately upper half and a bottom surface portion 46 forming a curved surface of an approximately lower half. The ceiling surface portion 44 and the bottom surface portion 46 may not be completely sectioned in the center, and, for example, the ceiling surface portion 44 may be formed to be small only in a relatively upper region and the bottom surface portion 46 may be formed to be relatively large to the upper ceiling surface side than the center.

Both of the right lateral wall and the left lateral wall for connection between the ceiling surface 44*a* and the bottom surface 46*a* are called both lateral walls together. Both the lateral walls are formed bilaterally symmetric about the center axis line C1 of the inlet conduit 38 and the ascending conduit 40. A width of each of the inlet conduit 38 and the ascending conduit 40 in the discharge passage 14 in the left-right direction is equal to a width between both the lateral walls in the left-right direction. The center axis line C1 indicates an axis line passing a center axis of a conduit of the discharge passage 14.

As illustrated in FIG. 3, the inlet 38*a* of the inlet conduit 38 in the discharge passage 14 is formed such that a width of a front portion 48 in the left-right direction is larger than a width of a rear portion 50 in the left-right direction on a horizontal cross-section plane. Specifically the inlet 38*a* of the inlet conduit 38 is formed such that a maximum width w1 of the front portion 48 in the left-right direction is larger than a maximum width w2 of the rear portion 50 in the left-right direction on a horizontal cross-section plane.

The inlet conduit 38 in the discharge passage 14 is formed such that a width of a bottom surface portion 46 in the left-right direction is larger than a width of a ceiling surface portion 44 in the left-right direction on a cross-section plane perpendicular to the discharge passage 14 (vertical cross-section plane perpendicular to the center axis line C1 of the discharge passage 14). Specifically the inlet conduit 38 is formed such that a maximum width w1 of the bottom surface portion 46 in the left-right direction is larger than a maximum width w2 of the ceiling surface portion 44 in the left-right direction on a cross-section plane perpendicular to the discharge passage 14. The exit 38*b* of the inlet conduit 38 is also formed such that the maximum width w1 of the bottom surface portion 46 in the left-right direction is larger than the maximum width w2 of the ceiling surface portion 44 in the left-right direction on the cross-section plane perpendicular to the discharge passage 14.

In the inlet 38*a* of the inlet conduit 38, the front portion on the horizontal cross-section plane corresponds to the bottom surface portion 46 on the cross-section plane perpendicular to the discharge passage 14, and further, the rear portion 50 on the horizontal cross-section plane corresponds to the ceiling surface portion 44 on the cross-section plane perpendicular to the discharge passage 14.

The inlet conduit 38 is designed to form a trapezoidal conduit cross-section plane such that the maximum width w1 of the bottom surface portion 46 in the left-right direction is larger than the maximum width w2 of the ceiling surface portion 44 in the left-right direction on the cross-section plane perpendicular to the discharge passage 14.

Figure 4:
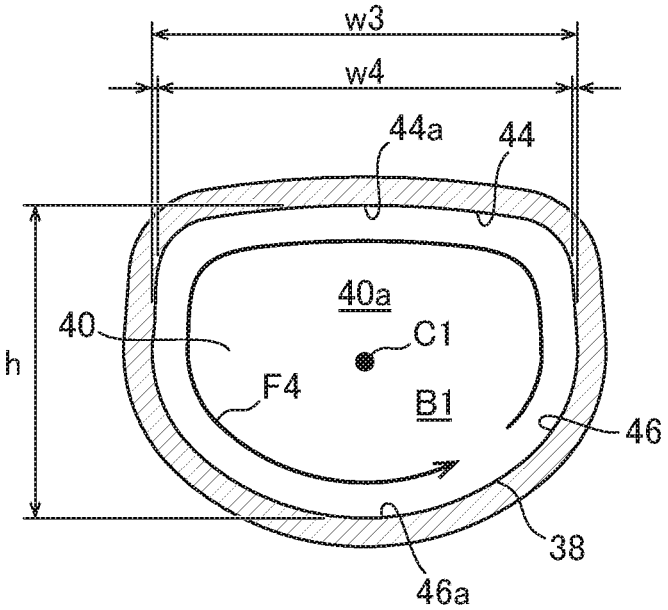
FIG. 4 is a cross-sectional view as shown along line IV-IV in FIG. 1.
Figure 5:
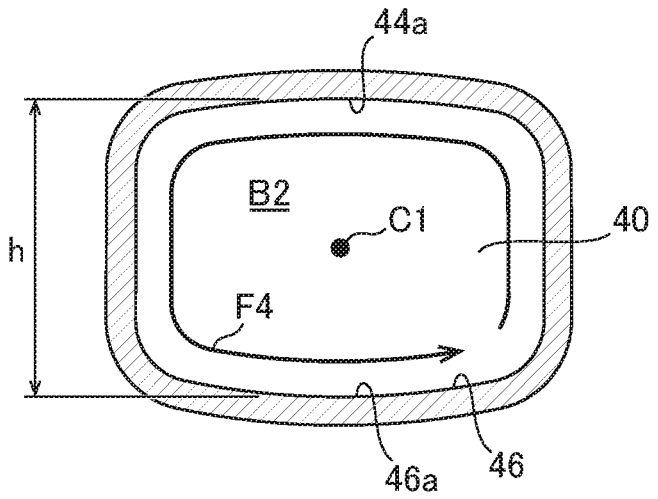
FIG. 5 is a cross-sectional view as shown along line V-V in FIG. 1.
Figure 6:
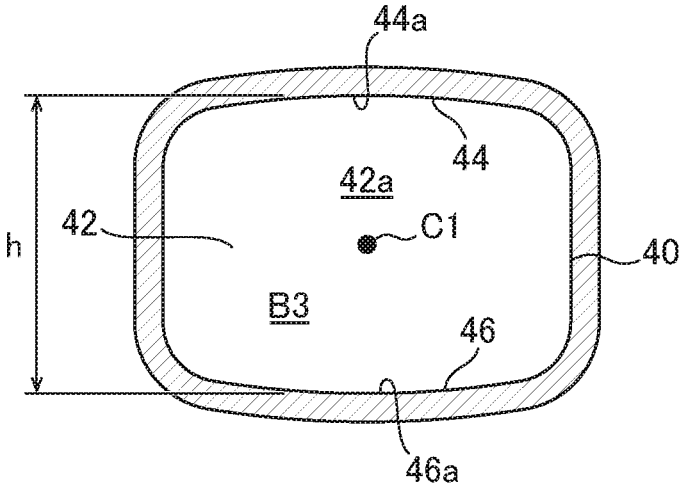
FIG. 6 is a cross-sectional view as shown along line VI-VI in FIG. 1.

As illustrated in FIG. 4, the ascending conduit 40 of the discharge passage 14 includes the inlet 40*a* connected to the inlet conduit 38, an exit 40*c* connected to the descending conduit 42, and an intermediate portion 40*b* formed between the inlet 40*a* and the exit 40*c*.

The ascending conduit 40 of the discharge passage 14 has the inlet 40*a* connected to the exit 38*b* in the inlet conduit 38. The inlet 40*a* in the ascending conduit 40 forms a flow passage that folds back from the exit 38*b* and turns upward in the lower portion of the discharge passage 14. The ascending conduit 40 obliquely extends upward from the inlet 40*a* and extends to the inlet 42*a* of the descending conduit 42. The ascending conduit 40 of the discharge passage 14 is also formed bilaterally symmetric about the center axis line C1.

The inlet 40*a* of the ascending conduit 40 is formed such that a width of the bottom surface portion 46 in the left-right direction is larger than a width of the ceiling surface portion 44 in the left-right direction on a cross-section plane perpendicular to the discharge passage 14. Specifically the inlet 40*a* of the ascending conduit 40 is formed such that a maximum width w3 of the bottom surface portion 46 in the left-right direction is larger than a maximum width w4 of the ceiling surface portion 44 in the left-right direction on the cross-section plane perpendicular to the discharge passage 14.

In this way, at least a part of the ascending conduit 40, for example, the inlet 40*a* is formed such that the maximum width w3 of the bottom surface portion 46 in the left-right direction is larger than the maximum width w4 of the ceiling surface portion 44 in the left-right direction on the cross-section plane perpendicular to the discharge passage 14. The intermediate portion 40*b* and the exit 40*c* in the ascending conduit 40 may be formed such that the maximum width w3 of the bottom surface portion 46 in the left-right direction is larger than the maximum width w4 of the ceiling surface portion 44 in the left-right direction on the cross-section plane perpendicular to the discharge passage 14. In this way, the ascending conduit 40 is designed to form a trapezoidal conduit cross-section plane.

The ascending conduit 40 is formed such that a height h between a bottom surface 46*a* and a ceiling surface 44*a* is substantially constant from the vicinity of the inlet 40*a* to the exit 40*c*. Further, the ascending conduit 40 is formed such that a height h between the bottom surface 46*a* and the ceiling surface 44*a* is substantially constant at least from the intermediate portion 40*b* to the exit 40*c*.

The ascending conduit 40 is configured such that a cross-section area B2 of a flow passage in a portion of the ascending conduit 40 lying downstream of the inlet 40*a* is made smaller than a cross-section area B1 of a flow passage in the inlet 40*a*. For example, a cross-section area B2 of a flow passage in an intermediate portion 40*b* lying downstream of the inlet 40*a* of the ascending conduit is made smaller than the cross-section area B1 of the flow passage in the inlet 40*a* of the ascending conduit. In addition, for example, a cross-section area B3 of a flow passage in the exit 40*c* lying downstream of the inlet 40*a* in the ascending conduit 40 is made smaller than the cross-section area B1 of the flow passage in the inlet 40*a*. Here, in the present embodiment, the cross-section area B2 of the flow passage in the intermediate portion 40*b* in the ascending conduit 40 is approximately equal to the cross-section area B3 of the flow passage in the exit 40*c*.

In the ascending conduit 40, the cross-section area of the flow passage is made smaller in the intermediate portion 40*b* and the exit 40*c* lying downstream of the inlet 40*a*, the cleaning water is collected in the narrower flow passage and the flow velocity is maintained to be relatively fast, thus making it hard for a push-out force of the cleaning water to the wastes to be reduced.

The aforementioned embodiment is an example where the present invention is applied to a washing-away type flush toilet that discharges wastes using a drop of the cleaning water supplied to the toilet main body 2 from the water storage tank 4 in a height direction of the bowl 8. The present invention can be applied to the other flush toilet with a siphon action, without a siphon action, or with a weak siphon action.

Next, an explanation will be made of an operation of the flush toilet according to an embodiment of the present invention.

First, when an operating level (unillustrated) is operated, a water discharging valve (unillustrated) provided in the water storage tank 4 opens, and a predetermined cleaning water amount (for example, 6.0 L) is supplied to the water conduit 10 through the supply opening 6 in the rear side of the toilet main body 2 from the water storage tank 4.

Next, the cleaning water flowing into the water conduit 10 flows to the right side of the toilet main body 2 in the upstream water conduit 28. That is, the cleaning water flows toward the right lateral side to be away from the center axis line C. When the cleaning water reaches the exit 28*a* of the upstream water conduit 28, the cleaning water turns to the left side in the bending portion 32.

Subsequently the cleaning water flows into the downstream water conduit 30 extending toward the left front side at the opposite side. The cleaning water forms a linear flow toward the exit 30*b* from the inlet 30*a* of the downstream water conduit 30 along the downstream water conduit 30 extending linearly.

The downstream water conduit 30 is formed relatively longer than conventional one, and the cleaning water linearly flows over a length L having a predetermined distance and a direction of the flow is adjusted relatively uniformly while maintaining the water momentum. Accordingly, the cleaning water can be suppressed from spreading to the left and right from the exit 30*b* of the downstream water conduit 30 to linearly flow along the center axis line A2.

As illustrated in FIG. 2, the cleaning water flowing out from the exit 30*b* of the downstream water conduit 30 flows in the rim water passage 20 along the flow line A3 of the cleaning water going around on the rim water passage 20. A flow amount per unit time toward the swirling direction of the cleaning water increases. As indicated at an arrow F1, a great deal of cleaning water forms a swirl flow to reach the right rear region through the left front region and the right front region in that order from the left rear region on the bottom surface of rim water passage 24 in the rim water passage 20.

In this way, the cleaning water, as indicated at an arrow F1, flows to swirl around the center of the bowl 8 in one direction in order of the left front region, the right front region and the right rear region from the left rear region in the rim water passage 20. Therefore as illustrated in FIG. 1 and FIG. 2, the cleaning water gradually flowing down from the slit aperture 26 formed in the inside of the bottom surface of rim water passage 24, as indicated at an arrow F2, also forms a swirl flow F2 to go around the entirety on the waste receiving surface 16 of the bowl 8. In a state of maintaining the water momentum of the flow of the swirl in the rim water passage 20, the cleaning water flows to form the swirl flow F2 on the waste receiving surface 16 and the swirl flow F2 flows down while swirling. Therefore water that swirls on the waste receiving surface 16 and in the pooled water portion 12 and gradually flows down concentrates reducing a diameter of the swirl flow F2, making it possible to strongly clean the waste receiving surface 16 and the pooled water portion 12.

The swirl flow F2 flowing down on the waste receiving surface 16 in the bowl shape reaches the inlet 38*a* of the inlet conduit 38 in the discharge passage 14 in the lower portion of the waste receiving surface 16. Since the inlet 38*a* of the inlet conduit 38 in the discharge passage 14 is formed such that on horizontal cross-section plane the width of the front portion 48 in the left-right direction is larger than the width of the rear portion 50 in the left-right direction, the swirl flow F2 flowing down on the waste receiving surface 16 tends to easily flow into the discharge passage 14 while keeping on the swirl from the inlet 38*a* of the inlet conduit 38. For example, the swirl flow F2 flowing down on the waste receiving surface 16, as illustrated in FIG. 1, tends to relatively easily flow into a front portion of the inlet 38*a* in the inlet conduit 38 from the front side of the waste receiving surface 16 formed more widely than the rear side and tends to easily flow into the discharge passage 14 while keeping on the swirl flow F2 formed on the waste receiving surface 16. In addition, for example, the swirl flow F2 flowing down on the waste receiving surface 16 tends to relatively easily flow into the front portion of the inlet 38*a* in the inlet conduit 38 from the front side of the waste receiving surface 16 relatively strong in the water momentum and tends to easily flow into the discharge passage 14 while keeping on the swirl flow F2 formed on the waste receiving surface 16. In this way, also in the inlet 38*a* in the inlet conduit 38, a swirl flow F3 in a rotational direction similar to that of the swirl flow F2 swirling on the waste receiving surface 16 can be formed. The swirl flow F3 forms a swirl flow swirling along the inner periphery of the inlet conduit 38, and forms the swirl flow swirling around the center axis line C1 of the inlet conduit 38. The swirl flow F3 forms a longitudinal swirl flow swirling from the bottom surface 46*a* to the ceiling surface 44*a*.

When the swirl flow F2 flows into the inlet 38*a* in the inlet conduit 38, since it is possible to suppress the swirl flow from being disturbed, the swirl flow can be relatively strongly formed in the discharge passage 14, and further, the swirl flow can be kept in the discharge passage 14 for a relatively long time.

The swirl flow F3 formed in the inlet 38*a* in the inlet conduit 38 of the discharge passage 14 flows down along the inlet conduit 38. Since the maximum width w3 of the bottom surface portion 46 in the left-right direction in which the cleaning water and the wastes tend to easily move under an influence of gravity is larger than the maximum width w4 of the ceiling surface portion 44 in the left-right direction in the inlet conduit 38, it is possible to suppress the swirl flow F3 from being disturbed in the vicinity of the bottom surface portion 46, the swirl flow F3 can be relatively strongly formed in the inlet conduit 38, and the swirl flow F3 can be more certainly maintained and kept up in the inlet conduit 38.

In addition, since the maximum width w3 of the bottom surface portion 46 in the left-right direction in which the cleaning water and the wastes tend to easily move under an influence of gravity is larger than the maximum width w4 of the ceiling surface portion 44 in the left-right direction in the exit 38*b* of the inlet conduit 38, it is possible to suppress the swirl flow F3 from being disturbed in the vicinity of the bottom surface portion 46, the swirl flow F3 can be relatively strongly formed in the exit 38*b* of the inlet conduit in the discharge passage 14, and the swirl flow F3 can be more certainly maintained and kept up in the exit 38*b* of the inlet conduit 38.

As illustrated in FIG. 1, the swirl flow F3 flowing down in the inlet conduit 38 flows into the inlet 40*a* of the ascending conduit 40 from the exit 38*b* of the inlet conduit 38. At least a part of the ascending conduit 40, for example, the inlet 40*a* is formed such that on the cross-section plane perpendicular to the discharge passage 14 the maximum width w3 of the bottom surface portion 46 in the left-right direction is larger than the maximum width w4 of the ceiling surface portion 44 in the left-right direction. Therefore it is possible to suppress the swirl flow F4 from being disturbed in the vicinity of the bottom surface portion 46, the swirl flow F4 can be relatively strongly formed in the ascending conduit 40, and the swirl flow F4 can be more certainly maintained and kept up in the ascending conduit 40. Since a height h of the swirl flow F4 formed between the bottom surface 46*a* and the ceiling surface 44*a* is maintained to be approximately constant in the ascending conduit 40, the swirl flow F4 swirling along the inner wall in the ascending conduit 40 can be more certainly kept in an approximately constant height.

Further, since the ascending conduit 40 obliquely extends upward from the inlet 40*a*, the swirl flow F4 of the cleaning water obliquely rises while swirling in the ascending conduit 40. At this time, the ascending conduit 40 is formed such that the cross-section area B2 of the flow passage in the portion lying downstream of the inlet 40*a* is smaller than the cross-section area B1 of the flow passage in the inlet 40*a* of the ascending conduit 40. Therefore the cleaning water is collected in a narrower flow passage in the portion lying downstream of the inlet 40*a* in the ascending conduit 40, a flow velocity of the cleaning water is hard to be reduced, and a push-out force of the cleaning water to the wastes can be hard to be reduced.

The cleaning water flowing out from the exit 40*c* of the ascending conduit 40, as indicated at an arrow F5, flows into the inlet 42*a* of the descending conduit 42, and the cleaning water flowing into the descending conduit 42 is discharged to a discharge conduit (unillustrated) mounted on a floor surface from the exit 42*b* of the descending conduit 42.

Also in the open rim type flush toilet 1 in which the slit aperture 26 is formed on substantially the entire circumference as in the case of the present embodiment, the cleaning water gradually flows down from the slit aperture 26 formed in the inside of the bottom surface of rim water passage 24 to clean the entirety of the waste receiving surface 16 of the bowl 8 by the swirl flow F2. The cleaning water flowing down in the bowl 8, as described above, together with wastes, keeps on the swirl flows F3 and F4 also in the inlet conduit 38 and the ascending conduit 40 in the discharge passage 14, making it possible to further enhance the discharging performance of the wastes, securing the excellent cleaning performance of the flush toilet. When the cleaning water and the wastes are discharged from the descending conduit 42 of the discharge passage, a series of cleaning operations of the toilet main body 2 end.

According to the flush toilet 1 in the present embodiment described above, in the flush toilet 1 that cleans the bowl 8 using the swirl flow formed by the cleaning water flowing down from the rim 18 of the so-called open rim structure, since the inlet 38*a* of the inlet conduit 38 in the discharge passage 14 is formed such that on the horizontal cross-section plane the maximum width w1 of the front portion 48 in the left-right direction is larger than the maximum width w2 of the rear portion 50 in the left-right direction, the swirl flow flowing down on the waste receiving surface 16 in the bowl shape tends to easily flow into the discharge passage 14 while keeping on the swirl from the inlet 38*a* of the inlet conduit 38. Therefore it is possible to suppress the swirl flow from being disturbed when the swirl flow flows into the inlet 38*a* of the inlet conduit 38, keep on the swirl flow in the discharge passage 14, and enhance the discharging performance of the wastes, securing the excellent cleaning performance of the flush toilet 1.

According to the flush toilet 1 of the present embodiment described above, since the maximum width w1 of the bottom surface portion 46 in the left-right direction in which the cleaning water and the wastes tend to easily move under an influence of gravity is larger than the maximum width w2 of the ceiling surface portion 44 in the left-right direction in the inlet conduit 38 of the discharge passage 14, it is possible to more certainly keep on the swirl flow in the inlet conduit 38, and further enhance the discharging performance of the wastes, securing the excellent cleaning performance of the flush toilet 1.

According to the flush toilet 1 of the present embodiment, since in at least a part of the ascending conduit 40 of the discharge passage 14, the maximum width w1 of the bottom surface portion 46 in the left-right direction in which the cleaning water and the wastes tend to easily move under an influence of gravity is larger than the maximum width w2 of the ceiling surface portion 44 in the left-right direction, it is possible to more certainly keep on the swirl flow in the ascending conduit 40, and further enhance the discharging performance of the wastes, securing the excellent cleaning performance of the flush toilet 1.

Further, according to the flush toilet 1 of the present embodiment, in the ascending conduit 40 of the discharge passage 14 the height of the swirl flow formed between the bottom surface 46*a* and the ceiling surface 44*a* can be maintained to be approximately constant at least between the intermediate portion 40*b* and the exit 40*c*, and it is possible to more certainly keep on the swirl flow, and further enhance the discharging performance of the wastes, securing the excellent cleaning performance of the flush toilet 1.

According to the flush toilet 1 of the present embodiment, in the ascending conduit 40 of the discharge passage 14, the cross-section area B2 on the cross-section plane perpendicular to the discharge passage 14 lying downstream of the inlet 40*a* in the ascending conduit 40 connected to the inlet conduit 38 is smaller than the cross-section area B1 on the cross-section plane perpendicular to the discharge passage 14 of the inlet 40*a* in the ascending conduit 40. Therefore since the cleaning water is collected in the narrower flow passage in the portion lying downstream of the inlet 40*a* in the ascending conduit 40, the push-out force of the cleaning water to the waste can be hard to be reduced.

According to the flush toilet 1 of the present embodiment, in the washing-away type flush toilet that discharges the wastes using a drop of the cleaning water supplied to the toilet main body 2 from the water storage tank 4 in the height direction of the bowl 8, it is possible to keep on the swirl flow in the discharge passage 14, and enhance the discharging performance of the wastes, securing the excellent cleaning performance.

What is claimed is:

1. A flush toilet that cleans a bowl using a swirl flow formed by cleaning water flowing down from a rim, comprising:

a toilet main body; and a water supply device that supplies the cleaning water to a supply opening of the toilet main body;

the toilet main body including:

the bowl having a waste receiving surface having a bowl shape, the rim provided on an upper portion of the waste receiving surface, a rim water passage formed on an entire circumference of the rim to introduce the cleaning water, and a slit aperture formed on a lower portion of the rim water passage, the cleaning water flowing down from the slit aperture;

a water conduit formed between the supply opening and the rim water passage, the water conduit comprising an upstream water conduit extending from the supply opening and a downstream water conduit connected to an exit of the upstream water conduit, the upstream water conduit extending toward one side with respect to a center axis line of the toilet main body in a left-right direction, the downstream water conduit extending toward the other side with respect to the center axis line of the toilet main body in the left-right direction, a wall surface on a side of the center axis line in the exit of the upstream water conduit being positioned in a region of said one side with respect to the central axis line in a plan view, a connecting portion between the upstream water conduit and the downstream water conduit forming a bending portion bending from a direction extending toward one side to a direction extending toward the other side, and an outer wall surface in an exit of the downstream water conduit being positioned in a region of said other side with respect to the central axis line in a plan view; and a discharge passage including an inlet conduit provided with an inlet connected to a lower portion of a pooled water portion in the waste receiving surface of the bowl, an ascending conduit extending upward from a lower end of the inlet conduit, and a descending conduit extending downward from the ascending conduit, wherein the inlet of the discharge passage has a front portion and a rear portion located at a rear side from the front portion in a front-rear direction on a horizontal cross-section plane, the rear portion of the inlet has rounded corner portions opposing each other in a lateral direction perpendicular to the front-rear direction and a center axis of the inlet conduit, the inlet of the discharge passage is formed such that a maximum width of the front portion of the inlet in the lateral direction is larger than a maximum width of the rear portion of the inlet in the lateral direction on the horizontal cross-section plane.

2. The flush toilet according to claim 1, wherein the inlet conduit of the discharge passage is formed such that a maximum width of a bottom surface portion of the inlet conduit in the lateral direction is larger than a maximum width of a ceiling surface portion of the inlet conduit in the lateral direction on a cross-section plane perpendicular to the discharge passage.

3. The flush toilet according to claim 1, wherein at least a part of the ascending conduit of the discharge passage is formed such that a maximum width of a bottom surface portion of the ascending conduit in the lateral direction is larger than a maximum width of a ceiling surface portion of the ascending conduit in the lateral direction on a cross-section plane perpendicular to the discharge passage.

4. The flush toilet according to claim 1, wherein the ascending conduit of the discharge passage includes an inlet connected to the inlet conduit, an exit connected to the descending conduit, and an intermediate portion formed between the inlet of the ascending conduit and the exit, wherein a height from a bottom surface of the ascending conduit to a ceiling surface of the ascending conduit is constant at least between the intermediate portion and the exit in the ascending conduit on a cross-section plane perpendicular to the discharge passage.

5. The flush toilet according to claim 1, wherein the ascending conduit of the discharge passage is formed such that a cross-section area in a cross-section plane perpendicular to the discharge passage lying downstream of the inlet connected to the inlet conduit is smaller than a cross-section area in a cross-section plane perpendicular to the discharge passage of the inlet.

6. The flush toilet according to claim 1, wherein the flush toilet is a washing-away type flush toilet that discharges wastes using a drop of the cleaning water supplied to the toilet main body from the water supply device in a height direction of the bowl.

* * * * *